US005301585A

United States Patent [19]

Hosaka

[11] Patent Number: 5,301,585

[45] Date of Patent: Apr. 12, 1994

[54] PUNCH PRESSING MACHINE

[75] Inventor: Makoto Hosaka, Hatano, Japan

[73] Assignee: Amada Sonoike Co., Ltd., Kanagawa, Japan

[21] Appl. No.: 888,127

[22] Filed: May 26, 1992

[30] Foreign Application Priority Data

May 27, 1991 [JP] Japan ..... 3-149257

[51] Int. Cl.[5] ..... B26D 5/12; B26F 1/04

[52] U.S. Cl. ..... 83/549; 83/564; 83/617; 83/618; 83/627; 83/859; 72/455

[58] Field of Search ..... 83/549, 618, 627, 859, 83/552, 559, 564, 571, 617; 72/420, 455

[56] References Cited

U.S. PATENT DOCUMENTS

| | | | |
|---|---|---|---|
| 494,546 | 4/1893 | Bradley | 83/549 X |
| 614,716 | 11/1898 | Hatleli | 83/571 X |
| 1,704,962 | 3/1929 | Bollaert | 83/552 |
| 1,728,475 | 9/1929 | Cavill | 83/549 X |
| 1,837,522 | 12/1931 | Bollaert | 83/552 |
| 1,926,985 | 9/1933 | Podrabsky | 83/571 X |
| 3,717,059 | 2/1973 | Daniels | 83/552 X |
| 3,882,746 | 5/1975 | Daniels | 83/552 |
| 4,125,045 | 11/1978 | Jeremi | 83/618 X |
| 4,532,843 | 8/1985 | Miyama | 83/549 X |
| 4,700,441 | 10/1987 | Ikeda et al. | 83/549 X |
| 4,823,658 | 4/1989 | Spicer | 83/617 X |
| 4,907,480 | 3/1990 | Kuroyone | 83/552 |
| 5,044,239 | 9/1991 | Endo et al. | 83/549 X |
| 5,076,127 | 12/1991 | Otto et al. | 83/549 X |

FOREIGN PATENT DOCUMENTS

| | | | |
|---|---|---|---|
| 1240019 | 7/1960 | France | 83/618 |

*Primary Examiner*—Hien H. Phan
*Assistant Examiner*—Clark F. Dexter
*Attorney, Agent, or Firm*—Rogers & Killeen

[57] ABSTRACT

Disclosed is a punch pressing machine requiring no turret, having punch units and die units as die sets, the number of which is not inferior to a turret punch pressing machine, and exhibiting a working accuracy superior to the turret punch pressing machine. A plurality of punch units and die units are disposed in two or more lines on a mounting plate member. A hammer member confronting the respective punch and die units is positioned in X-and-Y axis directions, whereby a workpiece can undergo necessary punch press working.

8 Claims, 3 Drawing Sheets

PUNCH PRESSING MACHINE

BACKGROUND OF THE INVENTION

Field of the Invention

The present invention relates to a punch pressing machine equipped with a plurality of punch and die units.

A punch press having a plurality of die sets has hitherto been known as a turret punch pressing machine.

The turret punch press, however, presents a problem in which a working accuracy depends on the positioning accuracy of the turret to align the punch over the die.

Known also is a punch pressing machine having the plurality of punch/die sets requiring no index positioning process. In this pressing machine, the plurality of die sets are simply arranged in one line, and the number of die sets is small. Hence, there arises such a problem that a working range is limited as compared with the turret punch pressing machine.

SUMMARY OF THE INVENTION

It is a primary object of the present invention in the light of the foregoing points to provide a non-turret type punch pressing machine equipped with a multiplicity of die sets.

According to one aspect of the present invention which has been devised to obviate the above-mentioned problems, there is provided a punch pressing machine comprising: a frame; work hands disposed on the frame in such a state as to be movable in X-and-Y axis directions on the plane of the frame for supporting a workpiece; a plurality of punch and die units capable of catching the workpiece from above and under; a mounting plate member, provided on the frame on which the punch and die units are arranged in at least two lines respectively in a posture orthogonal to the surface of the workpiece; and a hammer member disposed upwardly of the punch units in the plurality of lines for selectively performing a punching operation for each of the punch units while being moved and located in the X-and-Y directions.

BRIEF DESCRIPTION OF THE DRAWINGS

Other objects and advantages of the present invention will become apparent during the following discussion taken in conjunction with the accompanying drawings, in which.

DETAILED DESCRIPTION OF THE PREFERRED EMBODIMENT

An embodiment of a punch pressing machine of the present invention will hereinafter be described with reference to the drawings.

Figure 1:
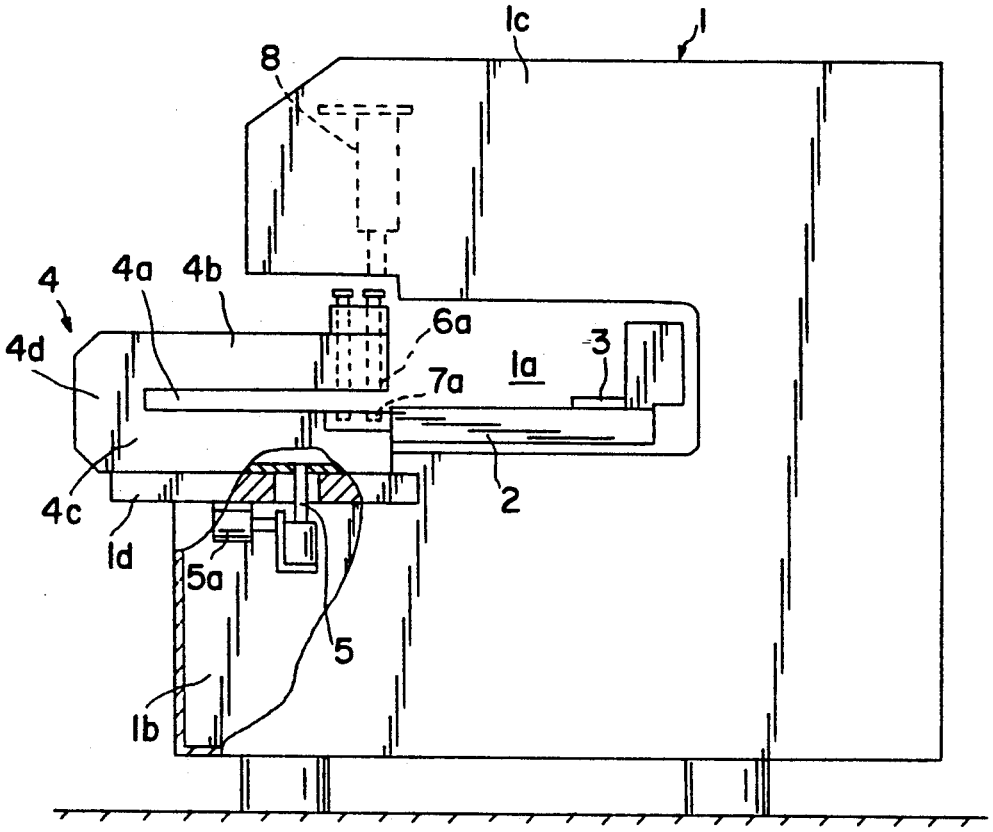
FIG. 1 is a side elevation showing one example of a punch pressing machine according to the present invention.
Figure 2:
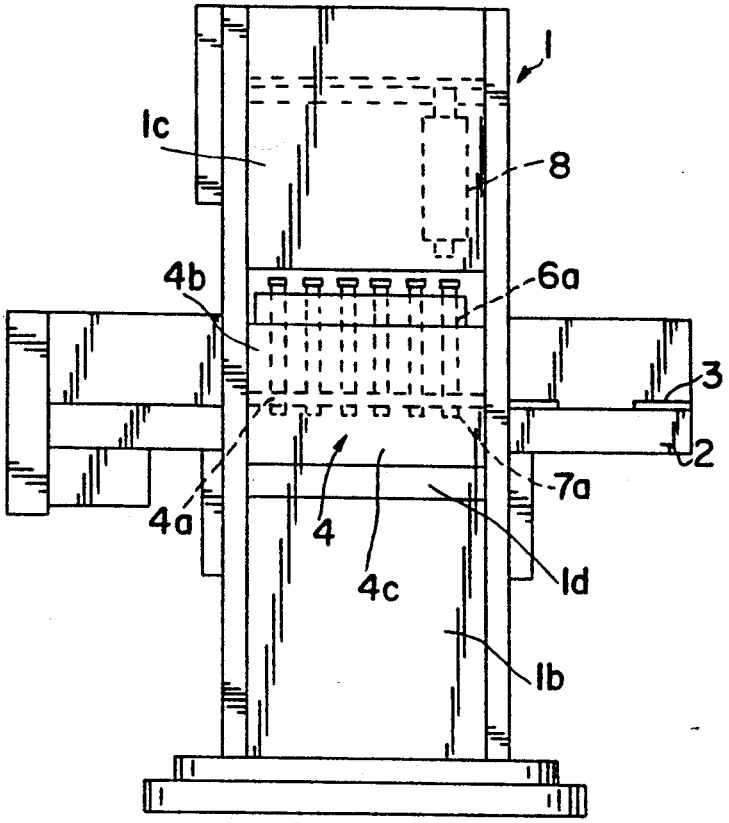
FIG. 2 is a front view of the punch pressing machine.
Figure 3:
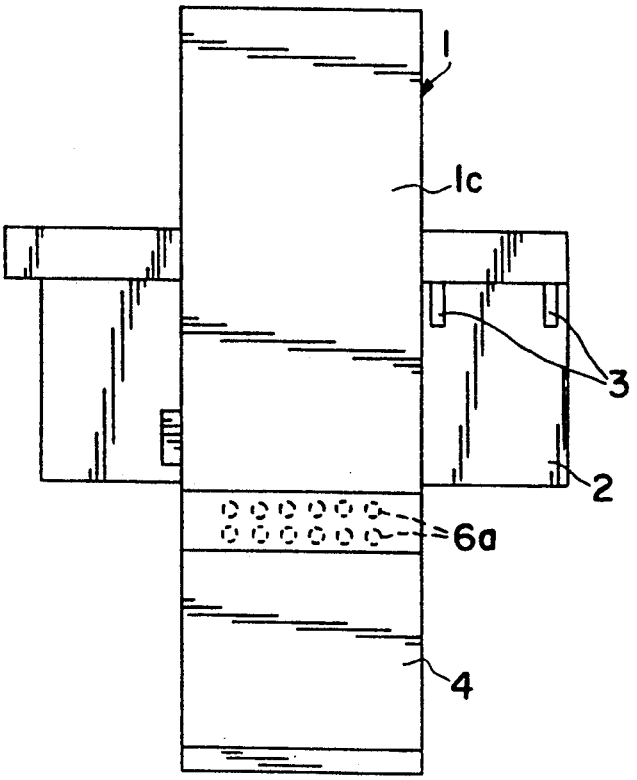
FIG. 3 is a top view of the punch pressing machine of this invention.

Referring to FIGS. 1 through 3, the numeral 1 represents a frame assuming a substantially C-shape in side (expressed in the reverse direction in the side elevation of FIG. 1). Designated at 2 is a work table horizontally mounted on the upper surface of a lower frame 1*b* inwardly of a cavity 1*a* in the frame 1. This table 2 is mounted with work hands 3 advanceable and retreatable (right and left directions of FIG. 1 which will hereinafter be referred to as X-axis directions) with respect to an opening portion of the cavity 1*a* in the frame 1 through a motor and a feed screw mechanism (unillustrated). At the same time, the table 2 itself is so mounted in a lower frame 1*b* as to be advanceable and retreatable in directions orthogonal to the X-axis directions with respect to the frame 1 (vertical directions on the sheet surface which will hereinafter be referred to as Y-axis directions) through the motor and the feed screw mechanism.

On the other hand, a base plate 1*d* is disposed on the lower frame 1*b* on the side opposite of the table 2, i.e., at the opening portion of the frame cavity 1*a* in the X-axis directions of the cavity 1*a* of the frame 1. A mounting plate member 4 is formed with a gap 4*a* into which a workpiece (blank) is insertable on the plate 1*d* and shaped in a laterally elongate C-like configuration in side view. The mounting plate member 4 is so mounted as to be turnable about a vertical turning shaft 5 with the opening portion of the gap 4*a* being directed to the table 2. This mounting plate member 4 can be moved horizontally clear of table 2 so that the mounting plate member 4 can be rotated about shaft 5 and, for this purpose, a slide mechanism 5*a* is connected to the shaft 5. Note that the table 2 may incorporate a relief function to avoid an interference of turning of the plate member 4 with the table 2.

Then, as one example, an upper member 4*b* positioned above the gap 4*a* of the mounting plate member 4 is detachably provided with punch units 6*a* arranged by sixes in two lines. Further, a lower member 4*c* positioned below the gap 4*a* is provided with die units 7*a* arranged by sixes in two lines corresponding respectively to the 2-line punch units 6*a*.

Each die unit 7*a* is so located as to slightly protrude into the gap 4*a* of the plate member 4 when it is to be used for punch press work. If unused, however, the die unit is located flush with or under the upper surface of the lower member 4*c*. Therefore, the lower end surface of each die unit 7*a* is supported on a lift mechanism (not shown) which utilizes a cylinder, a cam and the like. Only the one selected die unit 7*a* is so supported as to slightly protrude from the upper surface of the lower member 4*c*. According to the present invention, a plurality of die units 7*a* are referred to as a die set.

Indicated at 8 is a hammer member provided opposite to the above-mentioned punch and die units 6*a*, 7*a* with a hydraulic cylinder serving as a driving source in the upper frame 1*c* of the frame 1. This hammer member 8 is so supported as to be movable and locatable with respect to both the X and Y axes through a movement mechanism based on a stroke actuator such as, e.g., an air cylinder, whereby the hammer member can be positioned on the upper surface of each of the plurality of punch units 6*a*.

Figure 4:
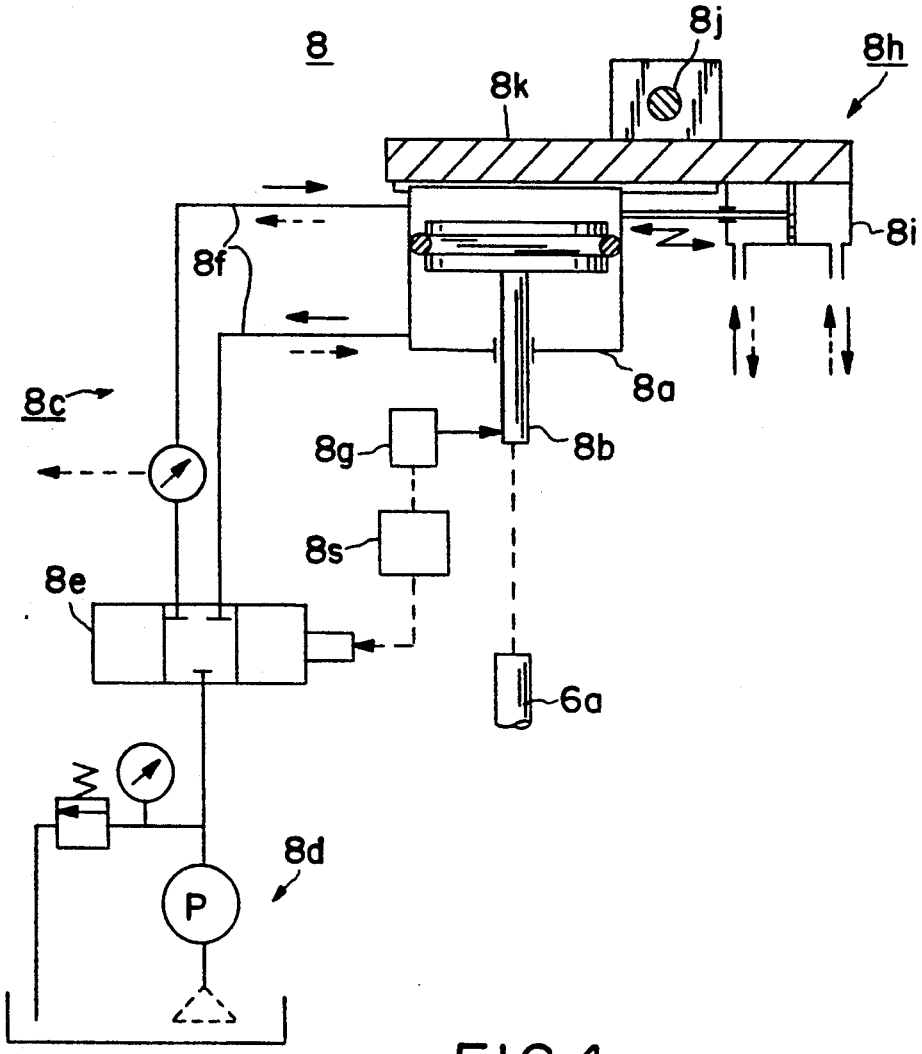
FIG. 4 is a block diagram showing one example of a drive system of a hammer member.

FIG. 4 is a mechanism block diagram showing one example of a drive control system of the hammer member 8. The symbol 8*a* denotes a hydraulic cylinder; and 8*b* a piston rod having its tip formed as a hammer for punching. A servo control drive hydraulic system 8*c* of the cylinder 8*a* is constructed of a pressure oil source 8*d*, a servo control valve 8*e* to be servo-controlled, pipes 8*f*, a stroke sensor 8*g* and a servo control unit 8S.

The symbol 8*h* represents an X-and-Y axis movement mechanism of the hydraulic cylinder 8*a*. This mechanism includes a member 8*k* fitted integrally with the hydraulic cylinder 8*a* wherein the member 8*k* is driven, with the aid of the air cylinder 8*i*, connected to the hydraulic cylinder 8*a*, in the X-axis directions and with aid of a feed screw mechanism 8*j* in the Y-axis directions.

In the thus constructed punch pressing machine of this invention, the working position of the workpiece (blank) such as a steel sheet or the like held in the posture horizontal to the work hands 3 is set between the predetermined punch unit 6*a* and die unit 7*a* by the positioning process of the work hands 3 in the X-and-Y axis directions. Simultaneously, the hammer member 8 is positioned with respect to the punch unit 6*a* concerned, and punching points of this hammer member 8 are basically the same with the conventional punch pressing machine.

In the hammer member 8 of this invention, however, the hydraulic cylinder 8*a* serves as the driving source and is driven while being servo-controlled by the control system composed mainly of the servo control valve 8*e*, the servo control unit 8S and the stroke sensor 8*g*. It is therefore possible to arbitrarily accelerate and decelerate especially the stroke motion. Hence, a dropping speed of the punch is infinitesimally controllable in accordance with a hardness and thickness of the workpiece. High-speed working with less noise is thus attainable.

On the other hand, the punch pressing machine according to the present invention includes the plurality of punch units 6*a* and die units 7*a* which are arranged in two lines, respectively. When the working position of the workpiece held by the work hands is set in the predetermined die set position, the hammer member 8 is positioned by the support mechanism thereof with respect to the X and Y axes above the punch unit 6*a* in the corresponding die unit. The punching operation is performed therein. Hence, this positioning control may not be as high as the turret punch press for index-positioning the die set. In this respect, there is an advantage in which the control drive system can be simply structured.

On the other hand, the punch pressing machine according to this invention has the plurality of die sets arranged in two or more lines. Therefore, when setting the working position of the workpiece to the predetermined die set by using the work hands 3, it can be considered that the work hands 3 interfere with other die units 7*a*.

According to the present invention, for avoiding this point, other unused die units 7*a* are located flush with or under the upper surface of the lower member 4*c* of the base member 4. Only the die unit to be used is protruded slightly from the upper surface of the lower member 4*c* by operating the lift support mechanism thereof.

Further, when replacing each die set, the mounting base member 4 of the die set can be turned about the shaft 5 for facilitating the operation.

Provided according to the present invention discussed above are the plurality of die sets in two or more lines which consist of the plurality of paired punch units and die units. The hammer member is so disposed as to be fixedly locatable with respect to the two X-and-Y axes for each die set. It is therefore possible to attain a variety of punch press works which are not inferior to those of the turret punch pressing machine without requiring the replacement of the die sets as compared with the conventional punch pressing machine equipped with the one-line die set.

Besides, the following advantage that only the workpiece and hammer member 8 may be positioned on the occasion of the punch press work. The turret index operation as done in the turret punch pressing machine, i.e., positioning on the die side is not effected. The working accuracy is more favorable, correspondingly. This advantage is brought about because of the fact that the die unit is not selected based on the turret structure. For this reason, the structure is simplified, and the profitability is given in terms of economical aspect such as manufacturing costs and maintenance costs.

Furthermore, the hammer member is drive-controlled by the servo-controlled hydraulic cylinder. The punching speed can be arbitrarily controlled during the operation in accordance with the content of the workpiece. Hence, a silent punch press work can be actualized.

Although the illustrative embodiment of the present invention has been described in detail with reference to the accompanying drawings, it is to be understood that the present invention is not limited to this embodiment. Various changes or modifications may be effected by one skilled in the art without departing from the scope or spirit of the invention.

What is claimed is:

1. A punch pressing machine comprising:

a C-shaped frame having means for supporting a workpiece in a cavity formed between upper and lower arms of said frame;

a C-shaped mounting plate member having upper and lower arms, said mounting plate member being rotatably carried by said frame lower arm so that the workpiece may be positioned in a cavity formed between said mounting plate member upper and lower arms;

said cavities of said C-shaped frame and said C-shaped mounting plate member being opposed for placing the workpiece therein;

said mounting plate member upper arm carrying a plurality of punch units in vertical registration with a plurality of die units that are carried by said mounting plate member lower arm; and a hammer member movably supported by said frame upper arm for selectively performing a punching operation with selected ones of said punch units.

2. The punch pressing machine as set forth in claim 1, further comprising a hydraulic cylinder operatively connected to said hammer member for driving said hammer member.

3. The machine of claim 2 further comprising servo control means for controlling a drive speed of said hammer member.

4. The machine of claim 1 wherein said punch units carried by said upper arm and said die units carried by said lower arm are each arranged in plural lines.

5. The machine of claim 1 wherein said C-shaped mounting plate is movable toward and away from said cavity of said C-shaped frame.

6. A punch pressing machine comprising:

a C-shaped frame having upper and lower arms with a cavity therebetween;

a C-shaped mounting plate having upper and lower arms with a cavity therebetween, said C-shaped mounting plate being rotatably carried by the lower arm of said C-shaped frame so that the cavities of said C-shaped frame and said C-shaped mounting plate are opposed when said mounting plate arms are aligned between said frame arms to form an enlarged cavity for a workpiece; and means for performing a punching operation on a workpiece in said enlarged cavity.

7. The machine of claim 6 wherein said means for performing a punching operation comprises:

plural punch units linearly arrayed in said mounting plate upper arm;

plural die units in said mounting plate lower arm, each of said die units being in vertical registration with a respective one of said plural punch units; and a hammer member movably carried in said frame upper arm for selectively performing a punching operation with a selected set of said vertically registered punch and die units.

8. The machine of claim 7 wherein said plural punch units and said plural die units are accessible when said mounting plate arms are moved out of vertical alignment with said frame arms.

* * * * *